US005341720A

United States Patent [19]

Franzén et al.

[11] Patent Number: 5,341,720

[45] Date of Patent: Aug. 30, 1994

[54] SYSTEM FOR REDUCING THE EFFECTS OF POWDER TEMPERATURE SENSITIVITY ON FIRING WITH GUNS

[75] Inventors: Arne Franzén, Karlskoga; Larseric Larsson, Degerfors; Neile Nilsson, Karlskoga; Lars-Berno Fredriksson, Kinnahult, all of Sweden

[73] Assignee: Bofors AB, Karlskoga, Sweden

[21] Appl. No.: 945,172

[22] Filed: Sep. 16, 1992

[30] Foreign Application Priority Data

Sep. 16, 1991 [SE] Sweden ..... 9102673-2

[51] Int. Cl.[5] ..... F41A 1/06

[52] U.S. Cl. ..... 89/45; 89/33.04; 89/41.03; 102/705

[58] Field of Search ..... 89/1.3, 1.35, 1.703, 89/14.05, 33.04, 34, 45; 102/282, 373, 430, 443, 705

[56] References Cited

U.S. PATENT DOCUMENTS

| | | | |
|---|---|---|---|
| 1,477,078 | 12/1923 | Rimailho | 89/1.1 |
| 3,216,323 | 11/1965 | Wengenroth et al. | 89/1.703 |
| 3,307,451 | 3/1967 | Bucklisch et al. | 89/1.703 |
| 4,655,411 | 4/1987 | Franzen et al. | 244/3.11 |
| 4,706,544 | 11/1987 | Zielinski et al. | 89/34 |

FOREIGN PATENT DOCUMENTS

| | | | |
|---|---|---|---|
| 330649 | 8/1989 | European Pat. Off. . | |
| 310008 | 11/1920 | Fed. Rep. of Germany | 102/443 |
| 1294267 | 4/1969 | Fed. Rep. of Germany . | |
| 602386 | 3/1926 | France | 102/443 |
| 667523 | 10/1988 | Switzerland | 89/6.5 |

*Primary Examiner*—Stephen C. Bentley
*Attorney, Agent, or Firm*—Pollock, Vande Sande & Priddy

[57] ABSTRACT

A system for reducing the temperature-dependent influence of the powder on the muzzle velocity of ammunition units on discharging of the ammunition units from a barrel of a large-caliber gun with high muzzle velocities includes a plurality of part charges having predetermined types, powder varieties, charge sizes and geometric dimensions of the powder, controlling unit for determining desired muzzle velocities based on predetermined parameters including influence of a powder temperature in the part charges during discharging from the barrel so that the desired muzzle velocity of respective ammunition units and barrel pressures do not exceed a predetermined acceptable value while ensuring the highest possible performance of the gun and for determining a corresponding predetermined combination of part charges to achieve the desired muzzle velocity, and selecting and assembling devices responsive to the signal from the controlling unit for selecting predetermined combinations of part charges from a plurality of part charges, so that the respective part charges in each combination contribute to achieving the desired muzzle velocity determined by the controlling unit.

13 Claims, 3 Drawing Sheets

SYSTEM FOR REDUCING THE EFFECTS OF POWDER TEMPERATURE SENSITIVITY ON FIRING WITH GUNS

TECHNICAL FIELD

The present invention relates to a system for compensating the dependence of muzzle velocity and barrel pressure on the temperature of the powder primarily in elevated muzzle velocities. The present invention is particularly applicable and effective at such velocities that approach the performance ceiling of the gun barrel. Thus, for example, the present invention is applicable in certain gun barrel types at muzzle velocities of up to approximately 1,000 m/s and above.

Background of the Invention

The problem of reducing $V_o$ and gun barrel pressure with reducing powder temperature is well known in the art. As the pressure reduces, the final combustion point is also displaced forwardly in the gun barrel. Low temperatures often have as a result that the final combustion point lies outside the muzzle, and consequently not all the powder is combusted when the projectile leaves the bore. Unavoidably, this results in a wide spread of the muzzle velocity between rounds, and, as a result, a considerable spread in the length of the shoot.

Traditionally, this problem has been solved by concentrating powder developments towards powder with as slight temperature sensitivity or dependence as possible and by refraining from utilizing the highest possible performance to its maximum. This also implies that powder with otherwise excellent properties has been rejected because of its high temperature-dependence.

It is previously known, in connection with firing of ammunition units from large caliber guns (for example, calibers of the order of between 9 and 30 cm), to employ charges which consist of pair charges which are composed or placed together immediately prior to loading of the gun.

SUMMARY OF THE INVENTION

A major problem in large-caliber guns with high muzzle velocities is the effect of the temperature dependence of the employed powder. It is a matter of some urgency to be able to gain control over the actual muzzle velocity, in particular the higher velocity range. The primary objective of the present invention is, among other thing, to obviate this problem. In one preferred embodiment, the system is to be capable of providing rapid and efficient part load compositions. It must be possible to execute such composition on site under field conditions without the risk of confusing the part charges and incorrect compositions. The compositions should preferably be capable of being automized or, in connection with manual assembly of the combinations, be capable of being verified in verification equipment which is energized for signals in relation to the temperature and desired muzzle velocity of the part charges, and give alarm signals in the absence of predetermined agreement.

According to the present invention the firing is effectuable by means of charges which make combinations of predetermined fixed part charges of different or identical charge types/powder varieties and/or charge sizes. Each respective part charge must, in each combination, make its contribution to the muzzle velocity effectuated by the combination. On establishment of each respective combination for achieving a desired muzzle velocity, account must, according to the present invention, be taken of a powder temperature prevailing on each firing occasion in the part charges, with a view to preventing the action of the powder temperature entailing that muzzle velocity and gun barrel pressure assume unacceptable levels. In such instance, it is important that the established maximum value for the gun barrel in question is not exceeded.

One object of the present invention is to permit the combination selection on each firing occasion to be selected so as to give a constant muzzle velocity irrespective of the prevailing powder temperature in the part charges. In such instance, the system can operate on the basis of the actually prevailing powder temperature and execute compositions in dependence thereof. In yet a further embodiment, the system is capable of operating with a discrepancy in the prevailing powder temperature and a generally established temperature, for example 20 °C, which forms the basis of a generally established composition of part charges for effectuating the contemplated muzzle velocity at the selected temperature. The abovementioned temperature discrepancy which, thus, entails that the generally determined composition gives a deviation in the muzzle velocity in relation to that desired may be counteracted or eliminated by modifying generally determined composition, for example by replacement, removal, or supplementation, of one of more part charges in the combination.

In one embodiment, the part charges in the selected combinations are arranged to make their substantial contribution to each respective muzzle velocity before each ammunition unit departs from the muzzle of the gun barrel. The number of different past charges available for selection can be two or more. The combinations may include part charges of the same type in certain combinations. If, moreover, these latter are intended to display predetermined lengths irrespective of the effectuated muzzle velocity, it may become relevant to utilize one or more blank charges which each give a zero velocity contribution in each respective combination. The structure of the part charges is, in such instance, preferably selected so that the muzzle velocity will, by choice of combination of the part charge, be substantially independent of the powder temperature, which affords particular advantages at the abovementioned elevated muzzle velocities. In addition, it is possible to achieve an optimum muzzle velocity for each firing, which 1, in addition to being of importance for ensuring that the maximum value of the gun barrel as far as pressure is concerned is not exceeded 1, also provides a degree of accuracy for calculating the strike point of the ammunition unit. The present invention is particularly applicable in cases in which the intention is, with the aid of such combinations, to ensure that the ammunition units and/or ammunition parts included therein which are discharged at different angles of elevation of the gun barrel and different points in time from the gun/guns will be activated simultaneously at one target/target area region.

In one preferred embodiment, use is made of a pool of part charges. In such an instance, the pool may comprise part charges of at least two different types and/or sizes. The composition of the different combinations is then effected by selection from the pool of part charges. The combination assembly process may then be carried out manually or mechanized. In a mechanized assembly, use is then preferably made of computer-based selector equipment which collects or selects from the pool, for example from magazines, part charges in response to incoming control signal/control signals, in which the powder temperature is, thus, included as a parameter.

The pool may also include the above-mentioned zero part charges which make a zero contribution on each respective firing. In addition to being selected for maximizing or maintaining constant the muzzle velocity, the combinations can also be utilized to make possible a muzzle velocity choice within a predetermined muzzle velocity range. This latter may be wide and embrace a region of from approximately 500 m/s to 800 m/s with respect to the difference between the maximum and minimum muzzle velocities within the range. One interval of particular interest in this context is that between approx. 250 m/s to approximately 1,000 m/s or higher.

The present invention also embodies a proposal of selector devices by means of which a number of part charges which are included in or comprise an assortment of part charges may be selected or sorted. The selector devices include or are controllable by means of a control unit which, in such instance, may comprise a computer-based unit. The control unit controls the selector devices by means of inputted information which may be represented in the control unit by means of one or more first (electric) signals. In response to these first signals, the control unit, for instance with the aid of a processing function, generates one or more second signals for controlling the selector devices. Such information includes or consists of data on absolute powder temperature, that is prevailing powder temperature in the part charges, discrepancies between generally determined powder temperature and current/prevailing temperatures in the part charges,and the like. The control unit and/or the selector device operates, in such instance, on a composition principle which is based on the above-mentioned absolute prevailing temperature in the powder in the past charges or the above-mentioned discrepancy in the temperature between prevailing temperature and a generally set temperature. The composition principle of the control unit or selector device, respectively, can, in this instance, be based on an unbiased part charge composition in combinations in dependence upon the prevailing temperature. The control unit or selector device may also operate with changes of combination templates programmed into the control unit/selector device and each allocated their unique muzzle velocity on the basis of the generally set temperature, for example 20° C. The part charge compositions selected and produced in the selector devices may be prepared using the above-mentioned programmed templates as a point of departure against which comparisons and adjustments are effected in response to the abovementioned temperature discrepancy.

The present invention will provide possibilities for efficiently counteracting undue gun barrel wear and/or excess pressure in connection with the discharging ammunition units from large-caliber guns,for example, guns of a caliber of between 12 and 5 cm. Each desired muzzle velocity can in principle be represented by its part charge composition which is selected on the basis of a predetermined starting temperature, for example 20° C. This basic composition of part charges may be adjusted using the actual or prevailing temperature as a point of departure so that it may be kept constant with the combination of the desired muzzle velocity. In particular at higher muzzle velocity ranges, the present invention is decisive for being able on each occasion to extract the maximum performance from the gun even if the selected powder in the ammunition is characterized by a high degree of temperature dependence. From the point of view of wear, the gun barrel is sensitive to velocities which lie in the region of the maximum permissible values of the gun barrel. As a result of the present invention, there will be achieved an efficient control over the muzzle velocity and barrel pressure within a large temperature range.

BRIEF DESCRIPTION OF THE ACCOMPANYING DRAWINGS

The present invention will now be described in greater detail hereinbelow, with particular reference to the accompanying drawings. In the accompanying drawings.

Figure 4:
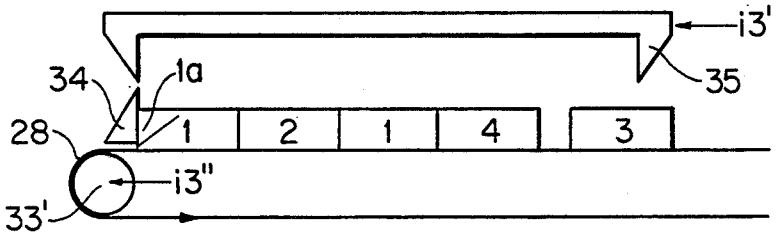
Figure 3:
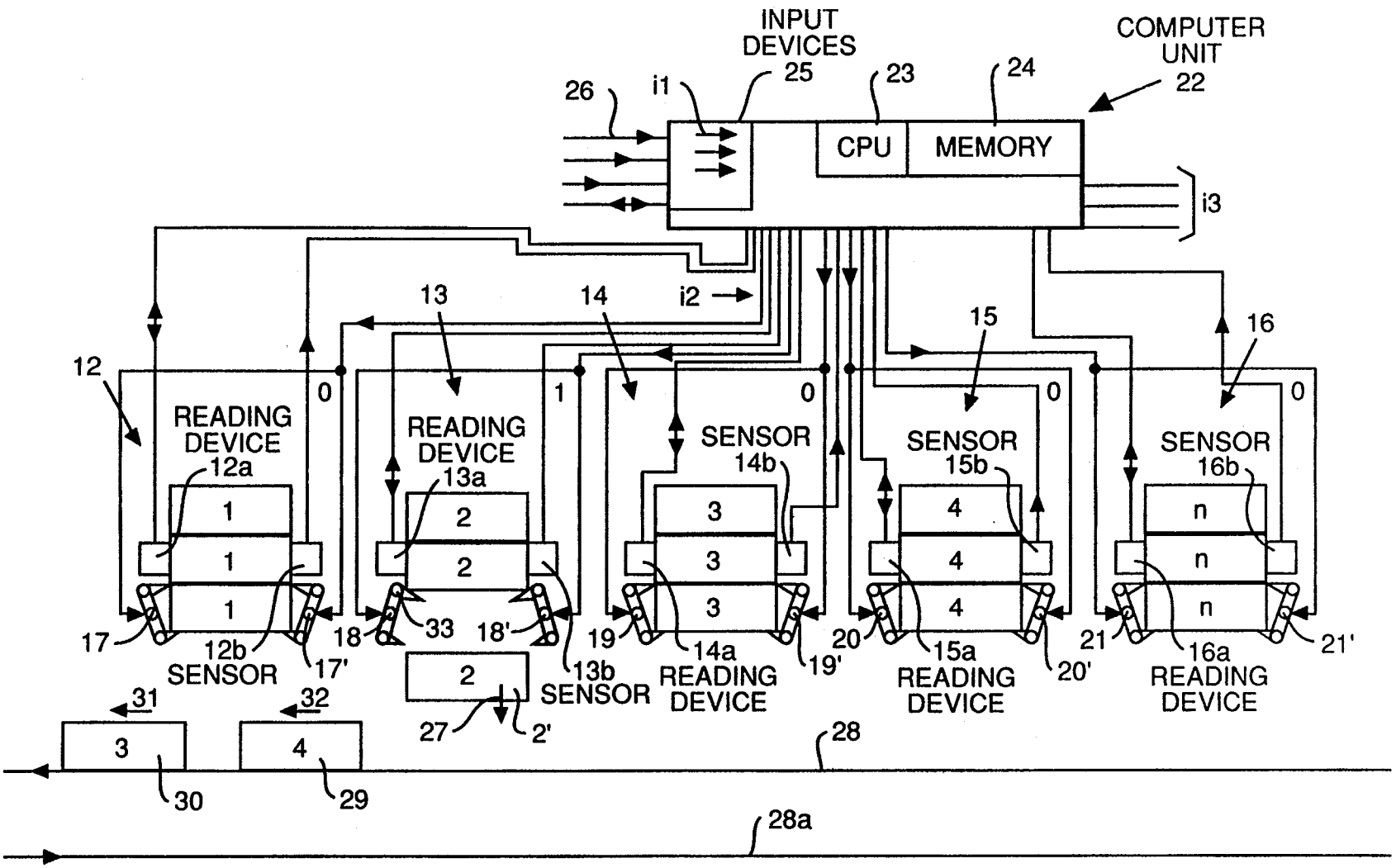
Figure 5:
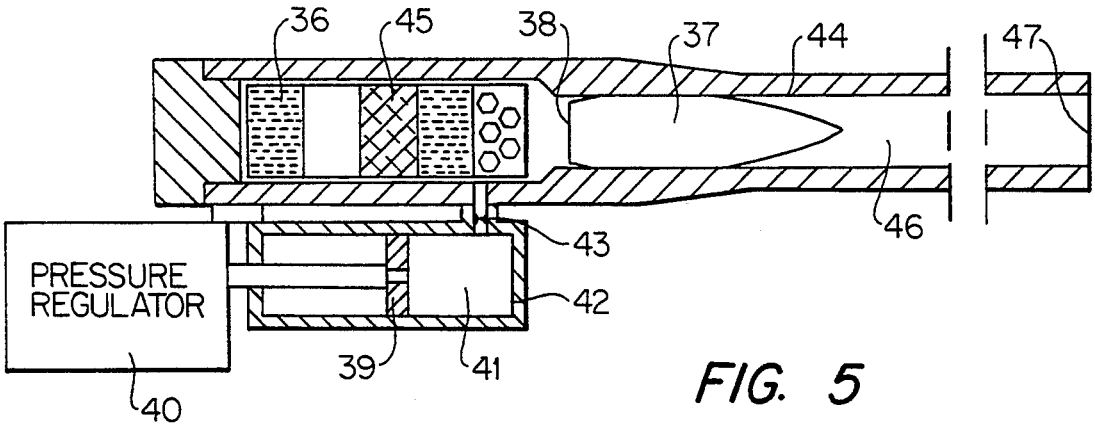
Figure 6:
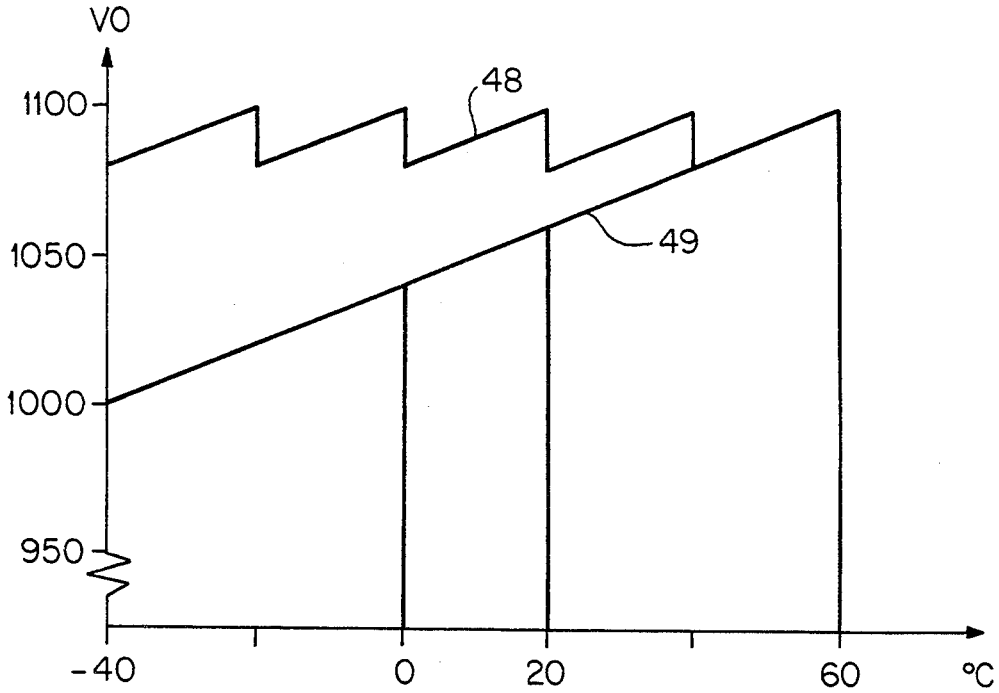
Figure 7:
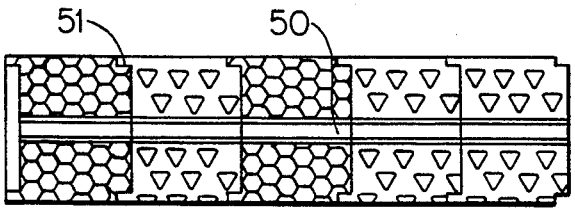

FIG. 3 schematically illustrates selector devices for the composition of the part charges and control unit for the selector devices;

FIG. 4 schematically illustrates an assembly station to which part charges are transported on a belt; and FIGS. 5 -7 show, in design and diagram form, gun, ammunition unit and functions.

DETAILED DESCRIPTION OF ONE EMBODIMENT

Figure 1:
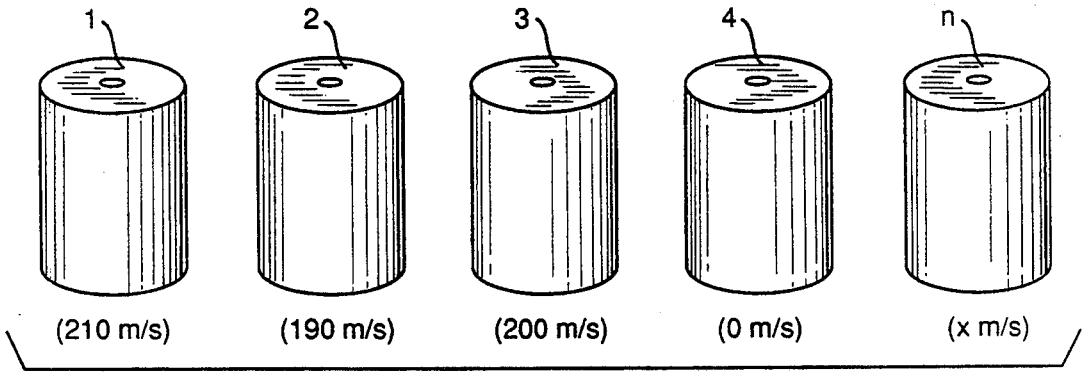
FIG. 1 shows in lateral perspective a number of part charges which may be composed in combinations so as to form a common charge for an ammunition unit, the part charges being included in a pool of part charges from which the part charges may be selected and composed.

In FIG. 1, a number of part charges are illustrated by references 1, 2, 3, 4 . . . n. The part charges are assembleable in combinations which are allocated to ammunition units in large-caliber guns, for example cannons, howitzers or mortars. Each part charge makes its velocity contribution in its combination. The combination may include a predetermined number of pair charges, for example five part charges. In FIG. 1, part charge 1 gives a velocity contribution of 210 m/s at +6° C., and 190 m/s at −40° C. The part charge 2 gives a velocity contribution of 90 m/s at +60° C. and 170 m/s at −40° C. At powder temperatures of −40° C, a charge build-up is selected with five part charges 1, there being then obtained a muzzle velocity of $5\times190$ m/s $=950$ m/s. At a powder temperature of +60° C, five part charges of type 2 are instead selected, there then being obtained a muzzle velocity of 950 m/s. If the selected powders have a linear temperature-dependence, at a temperature of 0° C, there will consequently be selected three part charges of type 1 and two part charges of type 2 which gives $3\times198$ m/s $+2\times178$ m/s $=950$ m/s. Thus, for each temperature it is possible to achieve the desired muzzle velocity within 10 m/s with powder varieties which otherwise would give a velocity difference of 100 m/s within the same temperature range. With a charge structure consisting of 10 past charges, it would of course have been possible to seduce the step to 5 m/s under the same conditions. Another alternative would be to increase the number of types of part charges by, for example, a type 3 which lies in the range of between 200 m/s and 180 m/s.

Figure 2:
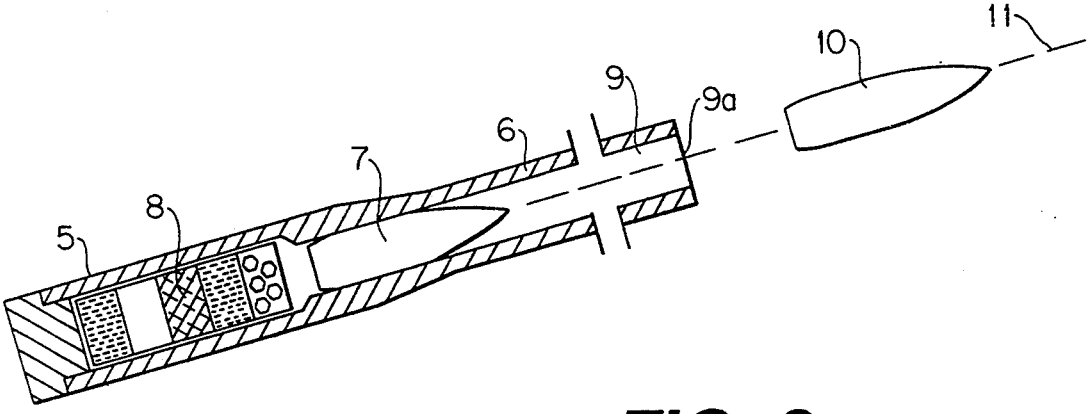
FIG. 2 is a side elevation schematically showing a large-caliber gun in which a first ammunition unit has been loaded and to which a charge consisting of part charges is applied, and a second ammunition unit departing from the muzzle of the barrel.

In FIG. 2, a large-caliber gun is symbolically designated as 5. The gun may be of known type and will not, therefore, be described in greater detail here. The gun comprises a barrel 6 and a first ammunition unit 7 is loaded in the gun. The ammunition unit is also assumed to be previously known and will not be described here. The charge of the ammunition unit is shown as 8 and, in accordance with the foregoing, the charge is composed of part charges according to Fig. 1 and, in such instance, may consist of five part charges. A parameter which forms the basis of the accuracy of $V_o$ is that the compositions of the part charges 8 be such that complete combustion of the part charges takes place before the ammunition unit 7 departs from the bore 9 of the gun. These part charges according to FIGS. 1 and 2 include or consist of different types/powder varieties and/or different charge sizes and/or powder dimensions for realizing the previously mentioned different velocity contributions. Since the part charges are stored separately, the powder in one part charge type need not be storage compatible with the powder in another part charge type. Thus, charges can be built up with different varieties of powder in combinations which had previously been considered impossible for reasons of storage safety. A second ammunition unit 7 departs from the muzzle 9*a* of the gun barrel at the velocity $V_o$. The expected ballistic trajectory of the ammunition unit 10 is shown by reference 11. The weapon may be fitted with charge volume regulatory devices or adjustable pressure release devices, for example an adjustable nozzle, which influences the pressure in the bore of the gun barrel in connection with the discharge of the ammunition unit 7. The influence of the pressure actuating device on muzzle velocity is then included as a parameter. Such devices have not been illustrated specifically, since they are previously known in the art.

An assembler unit is illustrated in FIG. 3. This unit comprises a number of magazines which correspond to the number of different part charges present. Thus, a first magazine 12 contains part charges 1, a second magazine 13 contains part charges 2, a third magazine 14 contains part charges 3, a magazine 15 contains part charges 4 and the magazine 16 contains part charges n, and so on. The magazines are fitted with controllable discharger devices symbolically designated by references 17, 18, 19, 20 and 21. These last-mentioned devices 17 -21 are, together with 17'-21', controlled from a control unit 22. The control unit consists of or includes a computer-based unit, for instance a microcomputer which includes a CPU 23, external and/or internal memory devices 24, and so on as normally included in computer equipment. The computer unit 22 also includes adaptor devices 25 which receive incoming, inputted information 26 referrable, among other things to the prevailing powder temperature (outer temperature) in the part charges. The temperature can also be obtained using a sensor (not shown) which is directly coupled to 22 via the adaptor unit 25. Indicators 26" are intended for powder of charge designated "1", but such an indicator can also be disposed at each powder magazine. This is of particular importance if the magazines were to be exposed to varying temperatures, for example that one magazine was in the sun and sensors are placed in shadow. The desirable feature is that the temperature is measured in the powder, but for practical reasons the measurement must most generally be carried out on the outside of the part charge. The part charges can be handled and stored in environments where the temperature (the outer temperature) changes more or less rapidly. In this instance, reference is made to the fact that the ammunition is employed under field conditions where violent temperature changes may occur in connection with ammunition handling. By way of alternative or supplement, the above-mentioned first information may include temperature deviations in relation to an ideal temperature which has been selected for the system and may be, for instance, 20° C. Under this ideal temperature, the combination effectuates one of its compositions depending upon muzzle velocity $V_o$. When the actual temperature in the powder of the part charges deviates from the generally set temperature, the muzzle velocity $V_o$ is modified in a known manner. According to the present invention, such changes in the muzzle velocity are counteracted in that the part charge composition/combination is adjusted. Such adjustment can be effected by replacement of part charges in the composition by another type or performance-effectuating part charge, supplementation of part charge, and the like. The information 26 includes, in this case, alternative or supplementary information on deviation between the generally set temperature and the actual temperature. This information may also include information on a muzzle velocity which is to be effectuated on firing, range, wind information, ammunition type and the like. The information is converted into a signal representation i1 (in the present case electric signals). These signals, here designated first signals, are fed to the calculator unit (CPU) 23 of the control unit which, in a known manner, processes the incoming information. The memories 24 may include preprogrammed templates or patterns in which each muzzle velocity effectuated by the system is represented by basic models. In an alternative embodiment, the trajectory calculation proper takes place with the aid of a second calculator and, in this case, only the desired muzzle velocity need be transmitted to 22 via the adaptor 25 for the signals 26. Data on the gun and the various powder varieties can also possibly be transmitted to 22 via 25/26. The unit 22 can then itself read off what type of powder is loaded in each respective magazine 12, 13, 14, 15 and 16, via for instance a bar code on each charge, this being effected using the equipment 12*a*, 13*a*, 14*a*, 15*a* and 16*a*. The unit may also directly retrieve the temperature powder via the sensors 12*b*, 13*b*, 14*b*, 15*b* and 16*b* in order by such means to obtain a direct temperature reading on the powder. Suitably, all of the locks are normally set in the same position as 18, 18'so that measurement of the temperature and powder variety can be verified immediately prior to the part charge being released down onto the belt as a result of the locks executing a reciprocating movement. The memory 24 includes a database which describes how the gun, the charges and the projectile behave in combination and at different temperatures. On the basis of this data and possible calculation functions, 22 will be capable of making a combination of charges of the type 1, 2, 3, 4 . . . and n which gives the desired muzzle velocity. Alternatively, it can calculate that muzzle velocity which will be obtained at a given combination and temperature, whereafter the result is transferred to another superordinate unit. On the basis of the obtained muzzle velocity, this superordinate unit can thereafter execute a calculation, and possibly request adjustment of elevation, air resistance, split elevation/time and the time from firing until the projectile has reached its target. Using this information as a point of departure, the superordinate control equipment can then command fire in such a manner that the projectiles reach the desired target at the correct point in time. Each adjusted pattern can, in its turn, be grouped with a number of basic patterns in which the necessary adjustments of the basic patterns have been carried out in view of the temperature variations. Each muzzle velocity is thus represented by a basic pattern with associated adjusted patterns for modifications in response to the temperature. The control unit effectuates the actual compositions by representing these with the aid of second signals i2. These second signals may be present in binary form, in which event ones occasion activation of the devices 17–21 together with 17′–21′, while zeroes entail that no activation of these devices takes place In FIG. 3, the control unit is fitted with five outputs, one output for each magazine of the abovementioned magazines 12 –16. In each time phase when a part charge is to leave the system, the above-mentioned outputs are energized with zeroes and ones. In the case illustrated in FIG. 3, the device 18 in the magazine 13 is, at the pertinent time phase, activated with the binary FIG. 1, while the devices 17, 19, 20 and 21 assume unactivated state because zeroes are present on their corresponding outputs on the control unit. As a result of activation of 18, a part charge 2′ can leave the magazine and fall down in the direction of the arrow 27 to a transport surface 28 on an endless belt of a known type. The upper surface of the belt transports part charges 29, 30 fallen down onto the belt in the directions of the arrows 31, 32. The conveyor belt 28 is endless and the returning belt part is shown by reference **28*a*. Drive wheels and idler wheels in the path are not shown specifically, since the conveyor belt may consist of any of known type. The magazines 12 –16 are fitted with known locking devices 33 which make it possible for only one part charge to fall out of the relevant magazine on one activation of the devices 17 – 21 and 17′–21′. This locking function may be executed in a known manner. It will also be perceived by a person skilled in the art, that, in a design of the devices according to FIG. 3, a plurality of magazines 12 –16 may be actuated simultaneously if the composition function is not, in such instance, disturbed by the speed advancement of the belt 28. The locking devices 33 are disposed on all devices 17 –21 and 17′–21′. The unit 17, 17′ shows their position when holding the part charges in place in their magazine. The locks 18, 18′assume this position when a part charge is released down onto the belt 28. With the aid of the locking devices 33 on 18 and 18′, respectively, the remaining part charges in the magazine 13 can be prevented from falling down onto the belt 28. When the locks 18, 18′return to the same position as 17, 17′ in the figure, the next part charge in the stack will fall down from the lock 33 to the lower lock on 18 and 18′Since 18 and 18′are rockable back and forth, successive part charges can be released down onto the belt 28. In the same manner, all locks 17 –21 function together with 17′–21′. The locking devices 18, 18′ can thus obtain their control signals from the control unit 22 which, in such instance, emits successive signals on discharge of a plurality of charges from the same magazine. The successive control signals then take into account the speed of advancement of the belt 28, which can also be controlled from the control unit 22. The control signals issued by the control unit for the packaging device 35 and the belt are illustrated by third signals i3, a corresponding signal i3′ for the actuation of the packaging device 35 having also been indicated, as well as i3″ for the conveyor belt. The control unit 22 may alternatively operate with an unbiased composition function which is controlled on the basis of the absolute temperature which prevails for each respective part charge. The prevailing powder temperature is fed in together with the above-mentioned firing and ammunition data and compilation of the part charges is calculated without aid or with the aid of preprogrammed tables, patterns, and the like in the memory of the control unit 22**.

FIG. 4 shows an end station on the conveyor belt 28′ for which a drive wheel 33 has also been indicated. The end station is realized with the aid of an arrest member 34 against which the end surface **1*a* of the first arriving part charge in the composition may be brought into abutment, whereafter the other part charges are stacked against the first part charge and against one another via their end surfaces. In the present case, a combination of part charges has been selected such that part charges of types 1, 2, 1, 4, 3 are present in that order. The order between the different types, like the selection of types in the combinations can be selected in accordance with the foregoing with considerable freedom of choice. In the present case, a composite charge consisting of five part charges is shown. These part charges provide, in accordance with FIG. 1**, a calculated muzzle velocity, for example 810 m/s for a generally set temperature of 20° C. Thus, in the present case the temperature has proved to be 20° C. If the temperature had been otherwise, for example 15° C, the composition would have been different in accordance with the calculation undertaken in the selector equipment, and so on.

In FIG. 5, a gun is shown by reference 44 and an ammunition unit loaded into the gun by reference 37. The gun is provided with pressure actuating means in the form of a hydraulic ram 39 which regulates a space 41 in a cylinder 42. The cylinder space 41 is in contact with the rear plane 38 of the ammunition unit, in connection with firing of the ammunition unit 37 from the barrel 44, 46 of the gun. Like the ammunition temperature, the pressure constitutes a crucial parameter for the muzzle velocity $V_o$ of the ammunition unit. In the gun, a charge composed of part charges is designated 45. Activation of the charge 45 entails pressure and temperature increases in the bore 46 of the barrel behind the ammunition unit. It will readily be perceived that a volume, and thereby pressure regulation by means of the devices 39, 40 will entail influence on the muzzle velocity of the ammunition unit. The pressure cycle is dependent upon the area of the nozzle in relation to the combustion properties of the powder in dependence upon the pressure. A central feature of the present invention is that the part charges in the charge 36, 45 must have completely combusted before the ammunition unit departs from the gun barrel muzzle 46. The present invention should also be capable of being used in connection with target combatting procedures according to Swedish patent specification 8301651-9 corresponding to U.S. Pat. No. 4,655,411 in which the ammunition units are provided with devices actuable with the air resistance coefficient and activated in the ballistic trajectories of the ammunition units, so that the ammunition units are, in one way or another, retarded in order to strike at an exactly predetermined point. The present inventive concepts can also be combined with this known process. It is also possible to combat two or more different targets at the same point in time.

FIG. 6 shows a curve 49 which indicates the relationship between the muzzle velocity $V_o$ and the temperature of the powder. It will be apparent from the curve that the muzzle velocity increases with the temperature of the powder. If the velocity is approximately 950 m/s -1,000 m/s at −40° C. dumping, it will be 1,100 m/s at +60° C. The diagram also shows how it is possible to keep substantially constant the muzzle velocity $V_o$ throughout the entire temperature range of the weapon with the aid of the abovementioned combinations of fixed past charges of different designs and structures. The characteristic effectuated by the part charge combinations for muzzle velocity is apparent from the curve 48 in FIG. 5.

In accordance with the foregoing, the composition 51 of past charges may be executed in known manner such that an expedient ignition of the part charges is effectuated in the position of the charges in the gun. Thus, for example, according to FIG. 7 a central through channel 50 may be provided in the part charge system. Via this channel, pyrotechnical ignition gases can spread and ignite the part charges in a known manner. Since this principle is known in the art, it will not be described in greater detail here.

The proposed employment of part charges also makes it possible to utilize marking systems on the parts in those cases when these are to be selected and composed manually. In such an event, the composite part charge combination can be signal-energized or disposed in a verification device which senses the temperature conditions. The verification device may, in such instance, be provided with alarm signal emission which is actuated as soon as the manually composed combination has a combination which does not correspond to the above-mentioned powder temperature and/or ambient temperature. This may be put into effect using the same type of bar code equipment 12*a* -16*a* as employed at the magazines 12 -16, combined with a temperature sensor of the type 12*b*-16*b*. For purposes of unity, a unit of the same function as 22 will also be required in this case, but in which the unit simply issues a warning or stops firing of the gun if the charge is such that barrel tension may occur. This also implies that the same type of part charge can be employed in both manual composition as when effected automatically.

The present invention should not be considered as restricted to that described above and shown on the drawings, many modifications being conceivable without departing from the spirit and scope of the appended claims.

What we claim and desire to secure Letters Patent is:

1. A system for reducing the temperature-dependent influence of the powder on the muzzle velocity of ammunition units on discharging of the ammunition units from a barrel of a large-caliber gun with high muzzle velocities up to about 1,000 m/s, said system including:

a plurality of part charges having predetermined types, powder varieties, charge sizes and geometric dimensions of the powder;

means for storing said plurality of part charges;

controlling means for calculating desired optimum muzzle velocities within said high velocity range based on predetermined parameters inputted thereinto including a powder temperature prevailing in said part charges during said discharging from said gun barrel, such that said desired optimum muzzle velocities of the respective ammunition units and the gun barrel pressure do not exceed a predetermined acceptable value while ensuring the highest possible performance of the gun, and for determining corresponding predetermined combinations of part charges allowing to achieve said desired optimum muzzle velocities; and selecting and assembling means responsive to control signals from said controlling means for selecting said predetermined combinations of said part charges from said plurality of part charges, such that the respective part charges in each combination contribute to achieving said desired optimum muzzle velocity determined by said controlling means;

wherein said plurality of part charges are combinable into a plurality of combinations, the number of said possible combinations corresponding to said desired muzzle velocities allowing to efficiently control the barrel pressure and the muzzle velocities within said range of high muzzle velocities within a large temperature range.

2. The system as claimed in claim 1, wherein said controlling means includes a first calculator unit for calculation of the trajectory and said muzzle velocity for a certain target to be combatted in view of a predetermined ammunition and a second calculation unit for calculation of corresponding combinations of part charges based on the input signals from sensing means detecting powder temperature of said part charges.

3. The system as claimed in claim 1, wherein said storing means includes a plurality of magazines, one for each respective predetermined type of part charges.

4. The system as claimed in claim 1, wherein said predetermined combination of part charges on each firing occasion is selected so as to achieve a substantially constant muzzle velocity irrespective of the prevailing powder temperature in the part charges.

5. The system as claimed in claim 1, wherein said predetermined parameters include a discrepancy in the muzzle velocity which would have been caused by an actual prevailing powder temperature deviating from a preselected temperature forming the basis for a generally established composition of part charges and said controlling means determines modification in the generally determined composition by one of replacement, removal and supplementation of one or more part charges in said generally established combination to eliminate said discrepancy.

6. The system as claimed in claim 1, wherein said predetermined parameters include information required for said part charges in the selected combinations to make their substantial contribution to each respective muzzle velocity before each respective ammunition unit departs from the muzzle of the barrel.

7. The system as claimed in claim 1, wherein each combination includes two or more part charges.

8. The system as claimed in claim 1, wherein said part charges are included in a pool of part charges, from which pool the selection of part charges to each respective part charge combination is effected by said selecting and assembling means.

9. The system as claimed in claim 1, wherein said combination of the part charges is selected such that the muzzle velocity will be substantially independent of the powder temperature at elevated muzzle velocities so as to provide optimum muzzle velocities for minimum barrel wear.

10. The system as claimed in claim 1, wherein selection of each respective combination of part charges is to ensure that the ammunition units discharged at different elevations of the gun barrel and/or at different times are activated simultaneously at a target area; and wherein the combination selection includes one or more blank part charges so as to ensure that a desired length is obtained for the respective combination of part charges; and wherein the combinations are selectable so as to provide a muzzle velocity within a predetermined muzzle velocity range which is about 500 m/s to 800 m/s.

11. The system as claimed in claim 1 wherein said selecting means includes selector devices which are controllable by said controlling means, said controlling means including a computer control unit which controls the selector devices responsive to an inputted information which is represented in the control unit by one or more first signals; said computer control unit generating, responsive to said first signals, one or more second signals, for controlling the selector devices.

12. The system as claimed in claim 1, wherein said inputted information includes powder temperature, deviations between generally determined powder temperature and prevailing powder temperature in the part charges; wherein one of said control unit and said selector device determine and select said composition of part charges based on one of the prevailing temperature and a deviation between the prevailing temperature and a generally set temperature, said composition selection being further based on an unbiased part charge composition in dependence upon the prevailing temperature, with the aid of programmed models and templates which for one and the same muzzle velocity determine the composition for different temperatures occurring in the part charges, or a modification of models or templates programmed into one of said control unit and selector devices and each allocated to their unique muzzle velocity, against which combination models or templates, the produced part charge compositions are compared and adjusted in dependence on said respective temperature deviation.

13. A method for reducing the temperature-dependent influence of the powder on the muzzle velocity of ammunition units on discharging of the ammunition units from a barrel of a large-caliber gun with high muzzle velocities up to about 1,000 m/s, said method comprising the steps of:

providing a plurality of part charges having predetermined types of part charges, powder varieties, charge sizes and geometric dimensions of the powder;

storing said plurality of part charges;

calculating the desired optimum muzzle velocities within said high velocity range based on predetermined parameters inputted thereinto including a powder temperature prevailing in said part charges during said discharging from said gun barrel, such that said desired optimum muzzle velocities of the respective ammunition units and the gun barrel pressure do not exceed a predetermined acceptable value while ensuring the highest possible performance of the gun, and determining corresponding combinations of part charges allowing to achieve said desired optimum muzzle velocities; and selecting said predetermined combinations of said part charges from said plurality of part charges, such that the respective part charges in each combination contribute to achieving said desired optimum muzzle velocity determined by said controlling means;

combining said plurality of part charges into a plurality of combinations, the number of said possible combinations corresponding to said desired muzzle velocities allowing to efficiently control the barrel pressure and the muzzle velocities within said range of high muzzle velocities within a large temperature range.

* * * * *